United States Patent [19]

Smith et al.

[11] 4,204,622

[45] May 27, 1980

[54] ELECTRIC IMPACT TOOL

[76] Inventors: James E. Smith, 217 Meadowlook Way; James D. Cunningham, 2100 Topaz, both of Boulder, Colo. 80302

[21] Appl. No.: 785,784

[22] Filed: Apr. 8, 1977

Related U.S. Application Data

[62] Division of Ser. No. 580,246, May 23, 1975, Pat. No. 4,042,036.

[51] Int. Cl.[2] ..... B25C 1/06

[52] U.S. Cl. ..... 227/7; 29/432; 173/1; 173/53; 227/131

[58] Field of Search ..... 173/1, 13, 53, 93.5, 173/124; 227/120, 129, 131, 133, 147, 7, 136; 29/432

[56] References Cited

U.S. PATENT DOCUMENTS

| | | | |
|---|---|---|---|
| 1,823,644 | 9/1931 | Cossock | 227/136 |
| 2,487,530 | 11/1949 | Dirksen | 173/53 |
| 2,869,824 | 1/1959 | Hazak | 173/53 |

*Primary Examiner*—Paul A. Bell

*Attorney, Agent, or Firm*—Edwin L. Spangler, Jr.; Horace B. Van Valkenburgh

[57] ABSTRACT

This invention relates to an electric impact tool characterized by a pair of electric motor-driven counterrotating flywheels, at least one of which is movable relative to the other from a retracted inoperative position into an extended operative one closely adjacent the other flywheel whereby a ram is squeezed therebetween and impelled forward at high speed against a workpiece. The nosepiece of the tool frame is retractable although normally extended due to the spring bias urging it and the movable flywheel to which it is mechanically linked into disengaged position. These elements cooperate with one another and with a manually-actuated trigger such that the latter must be depressed and the nosepiece retracted in order to engage the high energy friction clutch defined by the flywheels so as to operate the ram. A flywheel speed control is provided for matching the ram impact to the workload. The nosepiece also includes an energy absorbing cushion effective to dissipate the excess energy carried by the ram at the end of its work stroke so as to prevent damage to the structure against which the nosepiece is pressed.

16 Claims, 12 Drawing Figures

ELECTRIC IMPACT TOOL

This is a division of application Ser. No. 580,246, filed May 23, 1975, now U.S. Pat. No. 4,042,036, Aug. 16, 1977.

Low energy electrically-powered impact tools are quite commonplace and are used for such applications as driving small nails and staples, loosening and tightening nuts, and setting deformable fasteners like small brass and copper rivets. Up to now, however, most all high energy impact tools, at least the hand held type, have been operated by compressed air. There are many obvious disadvantages to air-operated hand tools, not the least of which is the necessity for large hoses and a relatively stationary high volume air supply. The pressure regulators, lubricators, filters and the like ordinarily used with pneumatic equipment all serve to complicate the situation as well as make it more cumbersome and expensive.

While the concept of a high energy hand-held electrically-powered impact tool is, to say the least, an attractive one, it poses a number of problems which have heretofore remained unsolved. For instance, it can be demonstrated rather simply through the use of an arbor press and a scale that a peak force of about 1000 lbs. is required to drive a 16 penny (3.25") nail into semihard wood up to the point where its head lies flush with the surface of the latter. Since the nail obviously exerts an equal and opposite force on the driver and the operator could not possibly oppose a 1000 lb. peak force, a low velocity driver will not work regardless of the force developed thereby as it would merely be pushed back away from the workpiece rather than forcing the nail through it. Thus, both the time required to drive the nail and the mass of the driver become most important considerations, especially if the design parameters call for recoilless operation which is highly desirable.

Other practical parameters can be chosen for the tool such as, for example, its mass and contact velocity for the purpose of calculating the amount of latent energy that must be stored in the system as well as the type of mechanism that is required to transfer such energy to the workpiece in the brief time allotted for essentially recoilless operation. When this is done, such calculations reveal the fact that a considerable energy storage capability coupled to a very fast and efficient power transfer mechanism becomes an absolute necessity. Furthermore, such calculations reveal the utter futility of applying conventional approaches like solenoids to the solution of the problem because an electromagnetic unit capable of generating the required average power over the allotted time span would be so large and heavy as to be utterly impractical to say nothing of its cost.

The flywheel comes to mind as a mechanism which is both compact and lightweight yet, at the same time, possesses high energy storage capabilities. Unfortunately, however, it also constitutes a high speed rotating system with large undesirable precession moments that become most difficult to cope with and, in fact, almost insurmountable in a hand-held tool that must be positioned with considerable accuracy. The problems presented to the operator in coping with such forces as these make a single flywheel tool a very dangerous, if not in fact a lethal, instrument when loaded with nails or other fasteners that are ejected therefrom at high speeds because of the considerable difficulty associated with controlling same.

It has now been found in accordance with the teaching of the instant invention that a high energy electrically-driven hand-held impact tool can, in fact, be constructed that is capable of developing the 75 horsepower or so required to drive a 3¼ nail during a brief interval lasting a few thousandths of a second. In fact, a small fractional horsepower electric motor will be entirely adequate to answer the power requirements of a duty cycle calling for more than one actuation per second.

Not one, but a pair of substantially identical counterrotating flywheels, store the necessary energy and, in addition, when properly matched and oriented relative to one another, cooperate to cancel out the bothersome precession moments inherent in high speed rotating systems having flywheels. These same flywheels, when one is moved relative to the other so as to engage a friction ram positioned therebetween, coact to define an efficient high speed power transfer mechanism capable of imparting a considerable driving force to the ram in a matter of a few milliseconds. What's more, the clutch thus produced requires no synchronous engagement and, when properly designed, is free of slippage.

The incorporation of mechanical interlocks which require that the nose of the tool to be held firmly against the workpiece while the trigger is actuated to engage the clutch make the tool a safe one to operate while, at the same time, disabling it from discharging a fastener should it be dropped accidently. The motor speed control, while not exactly a safety feature, does provide the operator with the means by which he can reduce the ram energy to an appropriate level commensurate with the job being performed thus preventing damage to the workpiece.

Ordinary household current is entirely adequate as a power source and, in fact, the power demands are such that they could easily be supplied by batteries or a small self-contained generator, especially in the case of a low demand duty cycle. The problem becomes one of the time involved to get the flywheel drive motors up to speed rather than the dissipation of energy during the drive cycle which is minimal even with a small fractional horsepower motor.

The instant impact tool, when designed for use as a nailer, is readily adapted to accept commercially-available strips or belts of nails without modification. The same is true of other types of fasteners such as rivets and the like when similarly packaged. In general, such items would be housed in a spring-fed magazine of conventional design.

It is, therefore, the principal object of the present invention to provide a novel high energy hand-held electrically-driven impact tool.

A second objective is the provision of a device of the type aforementioned that uses the principle of a high speed flywheel as an energy storage medium yet is so designed as to be virtually free of any precession moments.

Another object of the within described invention is to provide an impact tool utilizing a matched pair of counterrotating flywheels as the energy transfer medium by means of which the latent energy stored therein is imparted almost instantaneously to the ram.

Still another objective is the provision of an impact tool having a ram operated by a self-locking virtually slipless high power friction clutch that eliminates the need for synchronous engagement inherent in toothed clutches.

An additional object is to provide an electrically-driven hand tool that is based upon a double counterrotating flywheel principle that is readily adapted to such applications as nail, rivet and staple drivers embossing tools, punches, chisels and other similar devices whose work cycle is predicated upon the high speed impact of a retractable ram.

Further objects are to provide a tool of the type herein disclosed and claimed that is lightweight, rugged, relatively inexpensive, versatile, safe, dependable, easy to operate, simple to service, powerful, efficient and even decorative.

Other objects will be in part apparent and in part pointed out specifically hereinafter in connection with the description of the drawings that follows, and in which.

Figure 1:
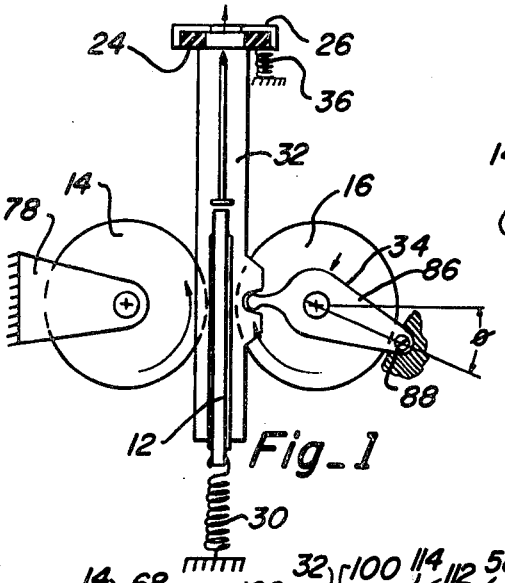
FIG. 1 is a schematic representation of the principle operating parts of the unit.

Before turning to a detailed description of a nail-driving embodiment of the present invention that has been broadly designated by reference numeral 10, reference will be made to the schematic view of FIG. 1 for the purpose of outlining the more important design features and parameters of the tool, some of which are quite critical. First of all, to get an idea of the force that must be generated by the tool and the time interval within which this force must be expended, a simple experiment coupled with a detailed mathematical analysis will be helpful.

It can be demonstrated experimentally with a simple arbor press that a 16 penny nail which is 3.25 inches long requires a peak force of about 1000 lbs. to drive it all the way up to the point where its head is flush with the surface of a piece of medium hard lumber. Furthermore, a graph of the force applied versus the degree of penetration shows a substantially linear relationship up to the 1000 lb. limit above noted. Therefore, the total energy expended ($E_o$) can be represented mathematically as follows:

$$E_o = \int_O^L F\,dL \approx 125 \text{ ft lbs.} \qquad \text{Equation (1)}$$

Since, in operation, the nail exerts an equal and opposite force upon the impact tool or driver, the time required to drive the nail and the mass of the driver become important considerations. If, therefore, we assume a 10 lb. weight for the driver which is reasonable for a hand-held tool, and we further assume a contact velocity of 5 ft./sec., the time available to insert the nail into the wood can be defined as follows where F(t) is the time varying force exerted on the tool by the nail, then, $$F(t) = MA = M(dv/dt) \qquad (2)$$

where M is the mass of the driver and td is time required to drive the nail. Accordingly, $$F(t)/Mdt = dv \qquad (3)$$

or, expressed another way $$\frac{1}{M}\int_O^{td} F(t)\,dt = \int_V^{V_f} dv \qquad \text{Equation (4)}$$

where $V_i$ is the impact velocity of the tool and $V_f$ is its final velocity. Having already determined that $$F(t) = 1{,}000(t/td) \text{ lbs} \qquad (5)$$

it follows from Equation (4) that $$1000td/2M = V_f - V_i \qquad (6)$$

Solving for td in Equation (6) we find $$td = \frac{2M\,(V_f - V_i)}{1000} \qquad \text{Equation (7)}$$

Now, substituting the assumed value of 5 ft/sec. for the impact velocity ($V_i$), a zero terminal or final velocity ($V_f$) and a mass M of 10/32, we find that $$td = \frac{2\,(10/32)\,(5)}{100} = .003 \text{ sec.} \qquad \text{Equation (8)}$$

Accordingly, using a 10 lb. tool with an initial velocity of 5 ft/sec. and recoilless operation ($V_f = 0$), three milliseconds of time are available to drive the nail.

The average power required during the drive time td can be calculated as follows:

$$P_{ave} = 125/(550 \times 0.003) = 75 \text{ hp} \qquad (9)$$

It becomes readily apparent from the above calculations that the tool must possess a considerable energy storage capability and, in addition, the ability to release said energy over a very short period of time, namely, a few milliseconds.

Now, if a flywheel adopted as the energy storage mechanism, and we use a 3 inch diameter on and assume an angular velocity of w, a meaningful comparison can be made between the peripheral flywheel velocity and the nail insertion speed, and the flywheel energy and required energy.

Assuming a 3 inch nail is driven in 0.003 seconds, this is a velocity of:

$$3/0.003 = 1000 \text{ in/sec.} \quad (10)$$

The angular velocity of a 3 inch flywheel with 1000 in.sec. peripheral velocity is:

$$w = \frac{1000}{1.5} = 666 \text{ rad./sec.} \quad \text{Equation (11)}$$
$$= 106 \text{ rev. sec.}$$
$$= 6366 \text{ r.p.m.}$$

This is a reasonable velocity and could be increased if necessary.

The energy of the flywheel is:

$$E = 0.5Iw^2 \quad (12)$$

where I is the angular inertia of the flywheel.

For a solid disc, 3 inch in diameter, the inertia is expressed as follows:

$$I = 0.5mr^2 \quad (13)$$

If, for example, brass is chosen for the flywheel and it is 1 inch thick, its mass is:

$$M = \frac{w}{g} = \frac{(535/1728)\ (\ /4)\ (9)\ (1)}{32} = .0684 \frac{\text{lb. sec.}^2}{\text{ft.}} \quad \text{Equation (14)}$$

Thus, substituting in Equation (13), $$I = 0.5(0.0684)\ (1.5/12)^2 = 5.34 \times 10^{-4} \text{ lb. ft. sec.}^2 \quad (15)$$

Using $w = 666$ rad./sec. the energy becomes:

$$E = 0.5(5.34 \times 10^{-4})(666)^2 = 118.43 \text{ ft. lb.} \quad (16)$$

Having already determined that approximately 125 ft. lbs. of energy was needed to drive a 3.25 inch nail up to the head in semihard wood, it becomes apparent that a 3 inch solid brass flywheel 1 inch thick rotating 7000 r.p.m. has ample energy and peripheral velocity to satisfy the needs of a high energy nailer.

Such a tool, however, if hand held, would likely develop significant precession moments when subject to angular rotation about axes perpendicular to the flywheel spin axis. The magnitude of this moments can be calculated as follows:

$$M_p = I\Omega w \quad (17)$$

where $M_p$ is the precession moment acting upon the nailer

I is the inertia of the nailer's flywheel w is the angular velocity of the flywheel $\Omega$ is the angular velocity that the operator attempts to rotate the nailer.

By way of example, assume the operator has a nailer with the previously-mentioned flywheel parameters and he attempts to reorient the nailer 180° in 0.1 sec., the resulting moment on the nailer due to gyroscopic precession is calculated as follows:

$$\pi \text{rad./0.1 sec.} = 31.4 \text{ rad./sec.} \quad (18)$$

$$M_p = (31.4 \text{ rad./sec.})5.34 \times 10^{-4} \text{ lb. ft. sec.}^2)(666 \text{ rad./sec.}) = 11.2 \text{ ft. lb.} \quad (19)$$

This is a significant torque and would make it very difficult for the operator to position the nailer at any desired location.

Accordingly, two functionally identical flywheels rotating in opposite directions about parallel axes at the same speed are needed to cancel out the precession moments that are most unwelcome in a hand-held tool that must be positioned carefully and accurately relative to a workpiece. It has now been found in accordance with the teaching of the instant invention that there are a number of other, more or less critical parameters that must be reconnected with.

One of the most significant is the fact that if a ram element 12 is pinched between a pair of counterrotating flywheels 14 and 16 which drive same forwardly against a workpiece as illustrated in the diagram of FIG. 1, then no slippage of any consequence can be tolerated if, as previously noted, the entire work stroke of the ram must be completed in a few milliseconds. In other words, if the tool is to be used to drive a 16 penny nail, it must be capable of transmitting a 1000 lb. force to the ram in a 0.003 second ram engagement time.

While a driving connection between the flywheels and the ram can be accomplished in more than one way, the only practical one seems to be frictionally as it requires no synchronous engagement as would a rack and pinion and the like. Furthermore, a clutch of some nature is necessary to bring the already spinning flywheels into instant driving engagement with the ram, it being an obvious impossibility to bring the flywheels up to the required speed and drive the ram all within a few milliseconds, yet, such would be necessary if the flywheels stayed in driving engagement therewith.

Now, such a clutch could either operate to shift both flywheels toward and away from one another to engage and disengage the flywheel or, alternatively, only on need move relative to the other, the movable one engaging the ram and pushing it sideways against the fixed one. Of the two, the latter approach is much to be preferred over the former for the reason that if the ram floats between two relatively movable flywheels, one will reach it ahead of the other each actuation rather than simultaneously. As this happens one flywheel of the pair will have to yield to the other in which the overbalancing force is present. It can be shown that these ram engaging forces are of the order of three times the force necessary to drive the nail, i.e. 3000 lbs. as compared with 1000 lbs; therefore, a yieldable flywheel mounting system becomes a most difficult mechanism to properly design and engineer. Furthermore, one is never sure what path the ram will follow on its forward excursion or work stroke as it may be on either side of its guideways depending upon which of the two flywheels has taken precedence over the other on the particular actuation. For the reasons above noted, one flywheel mounted for rotation about a fixed spin axis and clutch attached to the other operative upon actuation to narrow the gap therebetween is much the better way of solving the problem.

While it is certainly possible to shift the movable flywheel toward the fixed one along a line perpendicular to the direction of ram travel into its extended position, developing a ram-engaging force nearly three times the maximum work force developed in the ram becomes a serious problem. It has been found, however, that ram-gripping forces of sufficient magnitude can easily be developed by swinging the movable flywheel arcuately into engagement about an axis of pivotal movement lying to the rear of its spin axis. As the surface of the movable flywheel engages the adjacent ram surface and forces the ram over against the surface of the fixed flywheel, its direction of rotation is such as to roll it rearwardly thereby increasing the pressure it exerts against the ram. Such flywheel action upon engagement with the opposite ram surfaces instantly and easily develops the requisite ram-gripping forces even though they exceed the maximum driving force developed in the ram by a three-fold factor.

The theoretical arcuate excursion of the movable flywheel's spin axis is back into a plane passing through its axis of pivotal movement that is perpendicular to the direction of ram travel into its extended position. Once the spin axis passes rearwardly beyond this plane, however, the clutch loosens its grip on the ram and the driving connection is lost. If the system is to accommodate even minimal wear on the mating parts, therefore, the spin axis of the arcuately movable flywheel must be stopped short of this position. How far short presents an interesting question and one that is susceptible of precise, though unobvious, solution in accordance with the teaching found herein.

The force tending to propel the ram upwardly as schematically represented in FIG. 1 can be expressed as follows:

$$F_d = 2F_nK_f \tag{20}$$

where $F_n$ is the normal force between the flywheel and ram surface, and $K_f$ is the coefficient of friction between the ram and flywheel. In the same diagram, the downward force on the arcuately movable flywheel 16 is:

$$F_u = F_nK_f \tag{21}$$

From the geometry of the system, the force $$F_n = (F_u/\text{Tan}\ \theta) \tag{22}$$

where $\theta$ is the acute angle at the intersection of a plane defined by the spin axis of the arcuately-movable flywheel and its axis of pivotal movement and a second plane perpendicular to the direction of movement of the ram 12 into extended position.

By substituting Equation (21) into Equation (22) and simplifying, unexpectedly one finds that:

$$\text{Tan}\ \theta = K_f \tag{23}$$

Thus, knowing that slippage is critical and cannot be tolerated for all practical purposes, if $K_f \geqq \tan\ \theta$, the flywheels will not slip once engaged with the ram. It now becomes quite simple to select the angle $\theta$ or the coefficient of friction $K_f$ so that the foregoing critical relationship is present.

Note also that the flywheels are cylindrical and the engaged faces of the ram are planar so that they mate in tangential relation making straight-line contact with one another along a line parallel to the spin axis. Other complementary surfaces are unsatisfactory and to be avoided for the reason that points thereon at different distances from the spin axis will, of necessity, have different peripheral velocities and slippage is bound to result.

A few other points are worthy of specific mention before proceeding with a detailed description of the nail-driving embodiment of the impact tool. Motor size is a consideration and it depends upon the required duty cycle. As previously noted, the average power consumed is approximately 75 hp to drive a 16 penny nail so as to bury the head flush with the surface of the workpiece. Since energy is stored in the flywheels, the actual motor size required to drive them may vary from 0–75 hp depending upon the required duty cycle. If a duty cycle of 5 actuations/sec. is chosen and friction ignored, the required motor would be:

$$P_{req} = 75(5 \times 0.003)/(1) = 1.125\ \text{hp} \tag{24}$$

In other words, a 1.125 hp motor could maintain flywheel speed even using five actuations per second. Obviously, this is an excessive duty cycle from a practical standpoint and it becomes quite obvious that a small fractional horsepower electric motor would be entirely adequate. Furthermore, the amount of energy dissipated per actuation is such that battery power would be quite adequate to power the motors in light to medium duty applications over moderate time spans of a few hours or so.

Figure 12:
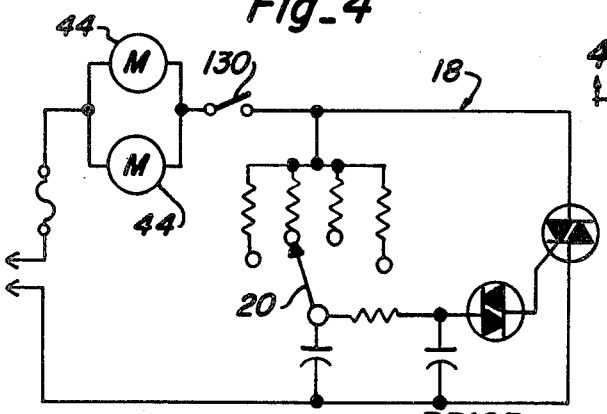
Fig 12 PRIOR ART
Figure 3:
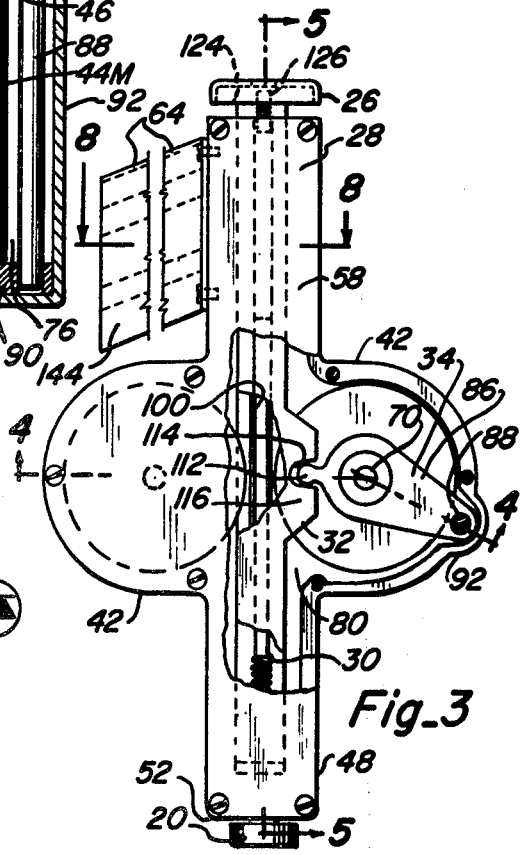
FIG. 3 is a top plan view of the tool to an enlarged scale, portions having been broken away to both conserve space and better reveal the interior construction.

Excessive ram energy can be a problem and provision needs to be made for controlling same. The first of two provisions for doing so is by means of a speed control 18 for the motor or motors driving the flywheels such as that shown schematically in FIG. 12 and upon which no novelty whatsoever is predicated, it being merely representative of one such speed control that could be used. The various positions of the control knob 20 can be indexed to positions on the scale 22 (FIG. 2) that are calibrated directly in nail sizes, for example.

Since enough energy must be imparted to the ram to insure completion of the work assigned thereto, a slight excess is ordinarily employed. To avoid damaging the workpiece due to the presence of this excess energy, however, means are preferably provided for dissipating some before it can cause the ram to dent, gouge, puncture, scar or otherwise damage the workpiece. An energy-absorbing cushion 24 is placed in the nosepiece 26 on the front end of the nozzle 28 of the case effective to receive and absorb some of the excess energy left in the ram as it nears completion of its work stroke. If, however, the ram is still being positively driven by the flywheels, such a cushion is inadequate. Accordingly, the length of the ram is preferably such in relation to the location of the flywheels behind the nosepiece that the ram has moved out of positive driven engagement therewith prior to its completing its work stroke or striking the cushion 24 as shown most clearly in FIG. 7. This means, of course, that the cushion is no longer required to absorb the direct energy being supplied to the ram by the flywheels at the end of its stroke, but only that energy left over due to its mass and velocity. Obviously, the lighter the ram, the less residual energy it has at the end of its stroke, all other factors being equal.

At the instant the ram moves forward beyond the flywheels and becomes disengaged therefrom, at least insofar as a driving connection therebetween is concerned, the clutch is free to reopen the gap between the flywheels and allow the ram to complete its cycle of movement by passing back therebetween under the influence of tension spring 30 connected thereto. In the particular form shown, the clutch actuating means comprises the nosepiece 26 which is mounted for retractable movement relative to the nozzle 28, and a rigid link 32 which operative connects the nosepiece to the pivoted frame 34 journalling the movable flywheel 16 for arcuate movement. As the nosepiece moves rearwardly into retracted position upon being pressed against a workpiece W in the manner shown in FIG. 7, like 32 acts upon the pivoted frame 34 to swing the movable flywheel rearwardly into engaged ram-driving relation. Once engaged, the ram cannot be released until it leaves the flywheels even if it were possible to return the nosepiece to its extended position during the few milliseconds it takes to complete the power stroke. Once the ram has, in fact, moved out of driving engagement therewith, the clutch is free to reopen the gap between the flywheels. This is accomplished automatically by a clutch release means connected to normally bias the pivoted frame 34 in a direction to open the gap between the flywheels. In the particular form shown, the clutch release means takes the form of a compression spring 36 normally biasing the retractable nosepiece 26 into extended position. Thus, before this particular clutch release means can function, the biasing force it exerts on the nosepiece must exceed the opposing retracting force exerted thereon by the workpiece W. As a practical matter, as soon as the ram has completed its work stroke, the operator will usually remove the nosepiece from engagement with the workpiece thus permitting the clutch release means to open the gap between the flywheels so spring 30 can retract the ram therebetween.

Figure 2:
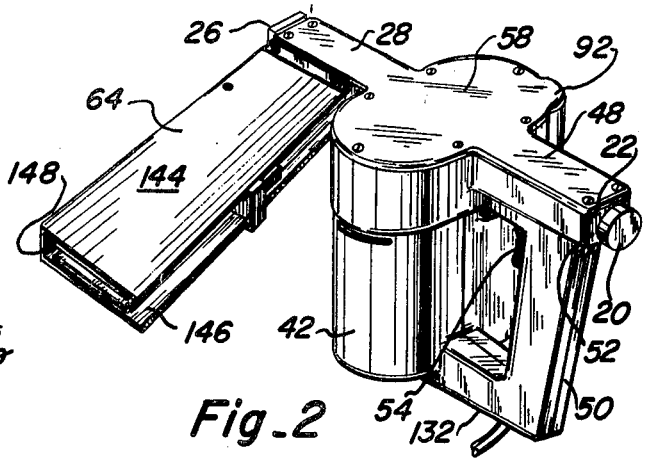
FIG. 2 is a perspective view of the tool as seen from a vantage point above and to the left of its rear end.
Figure 4:
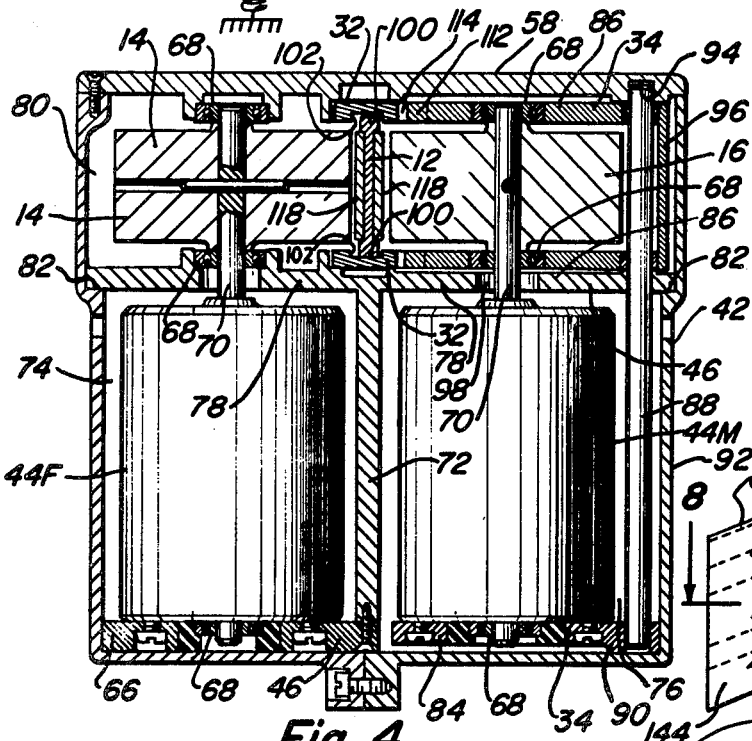
FIG. 4 is a transverse section taken along line 4—4 of FIG. 3 to a further enlarged scale.
Figure 5:
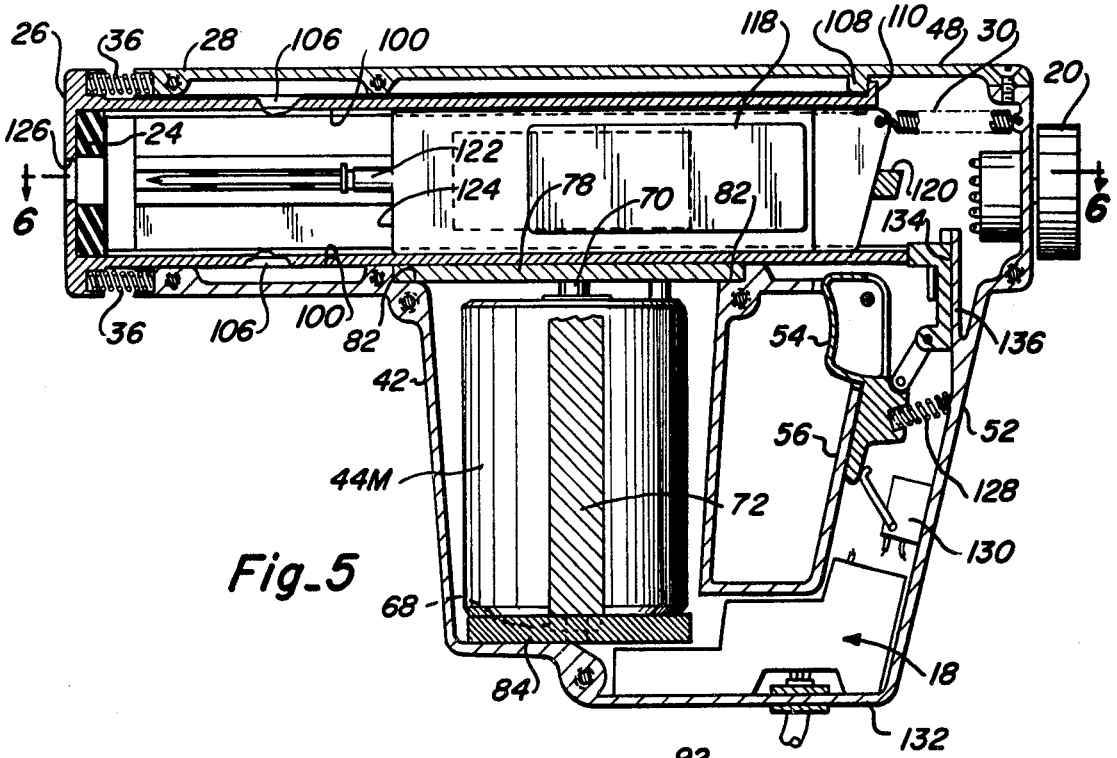
FIG. 5 is a longitudinal section to the same scale as FIG. 4 taken along line 5—5 of FIG. 3.
Figure 6:
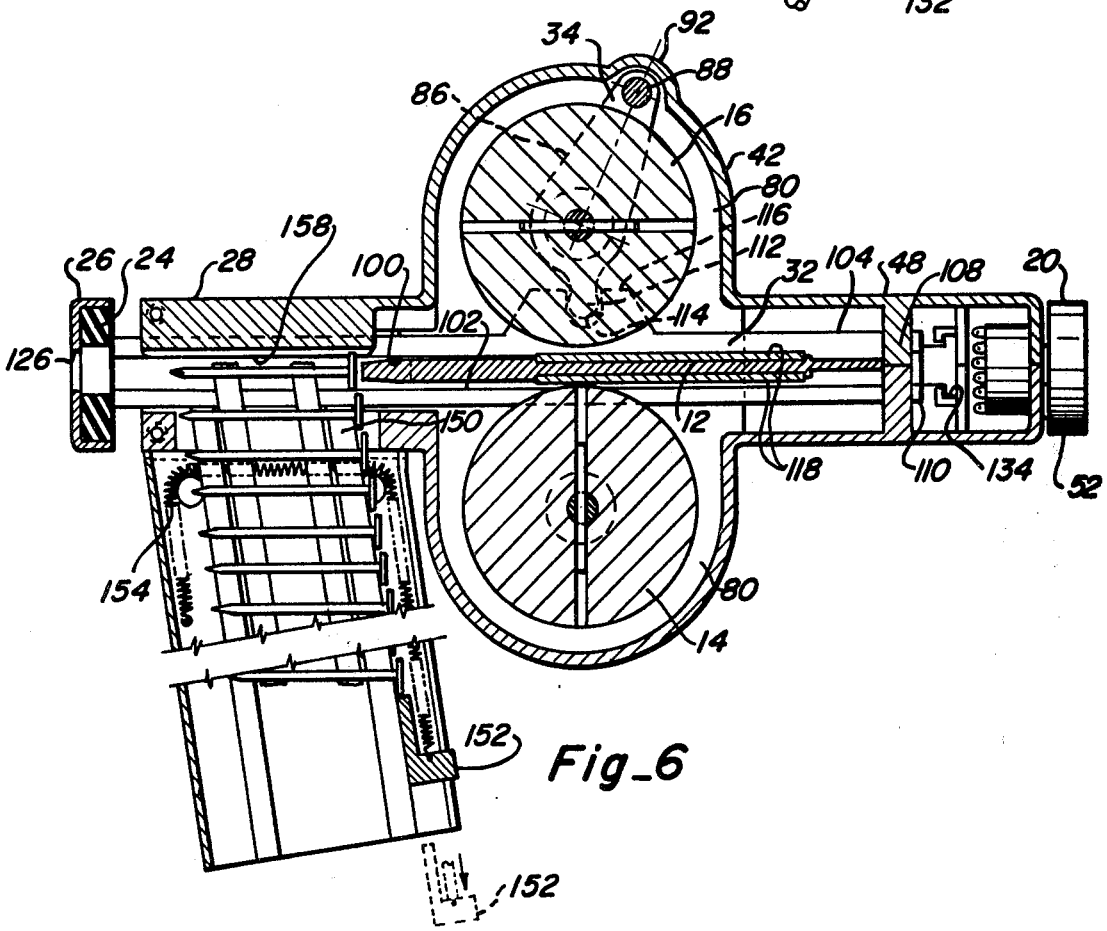
FIG. 6 is a section taken along line 6—6 of FIG. 5 and to the same scale as the latter figure, portions again having been broken away to conserve space.

Turning next to FIG. 2 where the nail-driving embodiment 10 of the tool has been shown in perspective, reference numeral 40 has been selected to designate the case or housing in its entirety, nozzle 28 forming a part thereof. Immediately behind the nozzle is an enlargement which will henceforth be referred to as the "flywheel cavity" 42 for lack of a better term. Within this cavity is housed the drive means in the form of a pair of identical electric motors 44, the movable mounting 34 for one of them, and the fixed mounting 46 for the other. Extending on rearwardly of the flywheel cavity as an integral part of the housing aligned longitudinally with the nozzle is the upper limb 48 of the handle 50. Limb 48 is hollow and adapted to receive the ram 12 in its retracted position as shown in FIGS. 5 and 6. In the particular form shown, speed selector switch 20 of the speed control 18 along with the scale 22 calibrated in nail sizes or the like are provided on the rearwardly-forcing wall 52 on the back of handle 50. The handle 50, as a whole, has the usual C-shaped configuration commonly associated with many electrically-driven hand tools. The handle 50 also carries the trigger 54 and the line cord 56 to the source of electrical power in the event a self-contained power source is not used.

As illustrated, the case has a removable cover plate 58 which provides access to the interior thereof and, in addition, it is shown die cast in two halves which are bolted together. The nail gun form of the tool, of course, requires an opening 60 (FIGS. 7, 8 and 9) into which the nails or other fasteners 62 are fed into the path of the advancing ram 12. A magazine 64 of conventional design has been shown feeding a commercially-available belt of nails into opening 60 in the side of the nozzle.

FIGS. 3–7, inclusive, to which reference will now be made, show the interior construction of the tool most clearly. Resting in the bottom of flywheel cavity 42 is a fixed endplate 66 which carries a bearing 68 journalling the shaft 70F of fixed motor 44F. An upstanding partition wall 72 divides the flywheel cavity into two motor compartments 74 and 76. A horizontal wall 78 formed integral with the partition wall 72 separates the motor compartments 74 and 76 from the flywheel compartment 80. The horizontal wall is shown supported on ledges 82 on the inside of the flywheel cavity. Additional shaft bearings 68 are mounted in fixed position in one half of the flywheel compartment, one being recessed in the top of the horizontal wall while the other is recessed into the lid. Fixed flywheel 14 is mounted on the portion of motor shaft 70F projecting from motor compartment 74 up into the flywheel compartment. Thus, the fixed motor 44F and its flywheel 14 are housed in one side of the flywheel cavity alongside ram 12.

Figure 7:
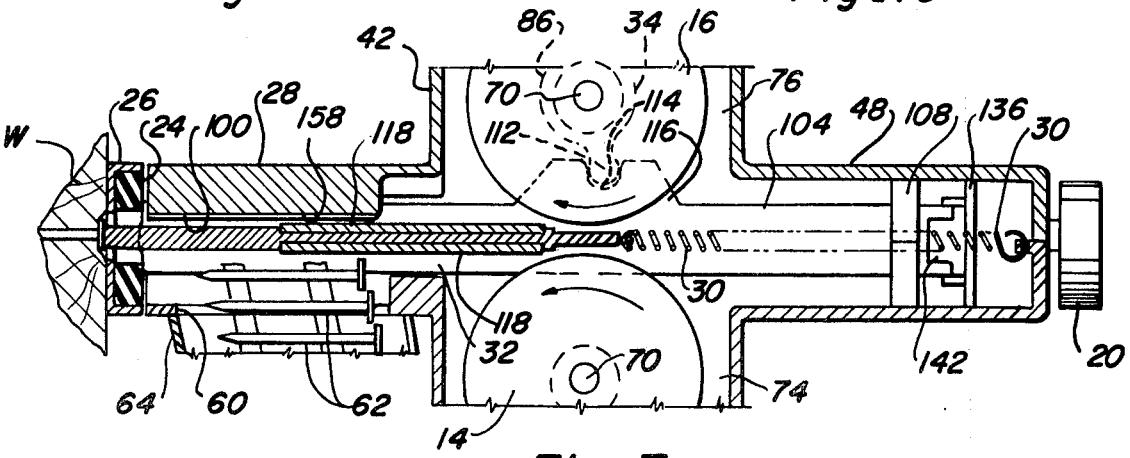
FIG. 7 is a fragmentary section similar to FIG. 6, but showing ram advanced into its fully-extended position.

In the other side of the flywheel cavity, is mounted movable motor 44M, its shaft 70M and movable flywheel 16. Fixed endplate 66 is replaced by movable endplate 84 that carries bearing 68 journalling the lower end of shaft 70M of the movable motor 44M. This endplate together with vertically-spaced parallel arms 86 cooperate to define the pivoted mounting means 34 that carries motor 44M and its flywheel for pivotal movement in a direction to vary the width of the gap so as to engage and form a driving connection with the ram. The lower end of pin 88 is non-rotatably fastened in an integrally-formed foot 90 provided on the underside of the movable endplate 88 which skids back and forth on the bottom of the housing. The housing is shown provided with an enlargement 92 to accommodate the pivot pin, the upper end of which is rotatably mounted in a socket 94 in the coverplate 58. As shown, arms 86 are joined together by a web 96 to define a unitary structure which is non-rotatably fastened to the pivot pin 88. These arms and movable endplate 84 each carry bearings 68 journalling the shaft 70 of motor 44M. An oversize aperture 98 in the horizontal wall 78 accommodates the shaft 70 of the movable motor and permits the entire pivoted mount 34 therefore to swing arcuately relative thereto between its engaged and disengaged positions. Note in FIGS. 1 and 3 that the axis of pivotal movement defined by the pivot pin 88 is located to the rear of the spin axis of the movable flywheel defined by movable motor shaft 70. Thus, even when fully engaged as shown in FIG. 7, the spin axis still lies well ahead of a plane passing through the axis of pivotal movement of the mount that is perpendicular to the path followed by the ram during its excursion into extended position or work stroke. As will be seen presently, the ram is loosely fitted for longitudinal slidable movement in the opposed track-forming grooves 100 of the clutch actuating means 32 so that it can move aside the fraction of an inch required to bring it into engagement with the fixed flywheel. Once thus engaged, however, the ram follows a straight-line path determined by the shoulders 102 of the track-forming grooves or guideway remote from the movable flywheel that is urging the latter thereagainst. It is for this reason that the angle $\theta$ in FIG. 1 and the normal plane have been defined in terms of the forward excursion of the ram. The return stroke of the ram, while confined to the guideway, need not follow a straight line and, in fact, can be slightly canted therein.

Directing the attention next to FIGS. 3–11, inclusive, it can be seen that a pair of rearwardly-extending parallel arms 104 are attached to the rear face of the nosepiece 26 and mount same within the nozzle for limited reciprocating movement between its normally extended position and a retracted one. These arms perform a dual function, the first of which is that of guiding the ram between its extended and retracted position due to the track-forming grooves 100 formed in the opposed surfaces thereof. Secondly, it is these same arms that are operatively linked to the arms 86 of the pivoted mount 34 and thus cooperates with the nosepiece to define the clutch actuating means 32.

These arms, while forming the guideway for the ram, are, in themselves, guided for limited reciprocating slidable movement in opposed grooves 106 formed on the underside of the lid 58 to the housing and the bottom walls of the nozzle 28 and upper handle limb 48 into which they telescope. In contrast to the ram 12, arms 104 are closely confined within the grooves 106 in the housing so that its movement is restricted to essentially straight-line motion.

Figure 11:
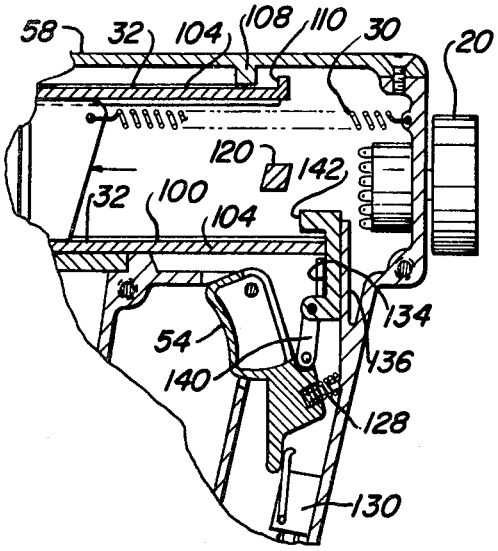
FIG. 11 is a fragmentary section like FIG. 10 except that the nosepiece is shown in retracted position; and, FIG. 12 is a schematic of a representative motor speed control circuit.
Figure 10:
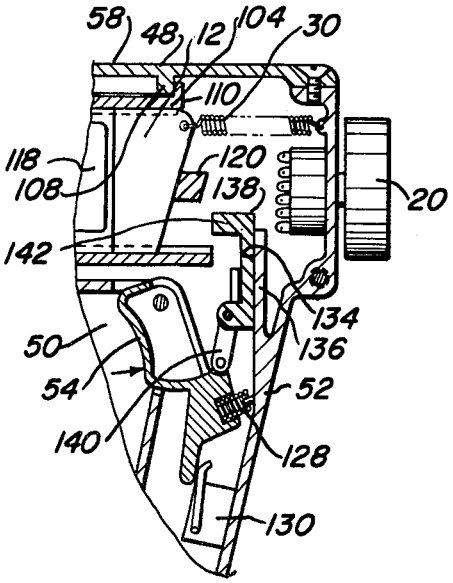
FIG. 10 is a fragmentary section similar to FIG. 5 and to the same scale as the latter showing the trigger actuated, but the nosepiece still extended.

As revealed most clearly in FIGS. 10 and 11, a fixed limit stop 108 provided on the underside of lid 58 engages a movable stop 110 carried by the upper arm 104 to limit the forward excursion of the clutch-actuating means 32. The rearward movement of the latter is stopped when the nosepiece 26 engages the front end of the nozzle. One or more compression springs 36 positioned between the opposed faces of the nozzle and nosepiece normally bias the latter into extended position. These springs constitute a clutch release mechanism automatically operative to disengage the clutch in a manner to be explained in detail presently as soon as the clutch actuating means 32 is deactuated by permitting the nosepiece to return to its normally-extended position.

Now, in FIGS. 3–7 it can be seen that the ends of arms 86 of the pivoted mount 34 remote from pivot pin 88 are provided with vertically-aligned ears 112 that are received in notches 114 formed in the boss 116 provided on one side of arms 104. The connection thus formed between the clutch actuating means 32 consisting of the nosepiece 26 and arms 104 operatively links the latter to the clutch means consisting of the flywheels and pivoted mount 34. As the clutch actuating means 32 is actuated by pressing the nosepiece against a workpiece with sufficient force to overcome the bias exerted thereon by springs 36 and retract same, it will swing the mounting means 34 rearward arcuately to close the gap separating the flywheels thus engaging the clutch by gripping the ram therebetween. As previously noted, once engaged, the clutch will remain so until the ram clears the flywheels as shown in FIG. 7. When this happens, the clutch can be disengaged and it will do so automatically under the influence of the clutch release springs 36 provided the clutch actuating means 32 has been deactuated. In other words, so long as the nosepiece remains pressed against the workpiece, ram retraction spring 30 will be pulling it back into contact with the flywheels, but they will not spread apart to allow it to pass therebetween. As soon as the pressure on the nosepiece is relieved to a point when the bias on the latter by clutch release springs 36 can extend it, the gap between the flywheels will reopen and the ram can complete its return stroke.

The flywheel engaging surfaces of the ram will both be seen to include friction pads 118 formed from some tough abrasion resistant material having a reasonably high coefficient of friction when placed in contact with a metal flywheel such as, for example, ordinary brake lining material. As ram retraction spring 30 biases the ram rearwardly, it strikes limit stop 120 shown in FIG. 5.

Figure 8:
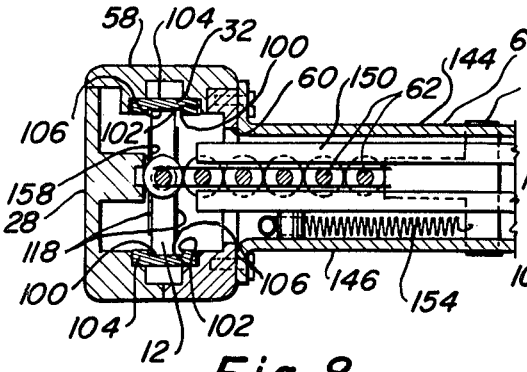
FIG. 8 is a fragmentary section taken along line 8—8 of FIG. 3 to an even further enlarged scale.
Figure 9:
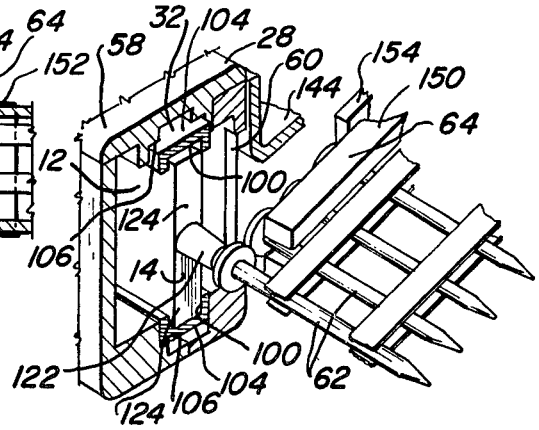
FIG. 9 is a fragmentary perspective view to the same scale as FIG. 8 and with portions broken away and shown in section to better reveal the interior construction.

The front end of the ram is shaped to define a nose 122 bordered both top and bottom by forwardly-facing shoulders 124 best seen in FIGS. 5, 8 and 9. The nose 122 passes through an aperture 126 sized to receive same in the nosepiece while the shoulders engage the shock-absorbing cushion 24 bordering the latter. Whatever energy is left in the ram at the completion of its workstroke is, hopefully, dissipated in this cushion, otherwise, the nose of the ram will impact against the workpiece itself.

Particular reference will next be had to FIGS. 5, 6, 7, 11 and 12 for a detailed description of the trigger 54 and an important safety interlock between the latter and the clutch actuating means 32. Trigger 54 is pivotally mounted within the opening in the handle in the usual manner and is normally biased forwardly by spring 128. As the trigger is manually actuated into retracted position it closes the normally-open on/off switch 130 in the motor speed control circuit 18, the latter having been shown located in the lower limb 132 of the handle.

A vertically disposed T-shaped slot 134 is formed integral with web 136 on the inside of the handle above the trigger. Mounted within this slot for limited vertically slidable movement is a limit stop 138 operatively connected to the trigger by link 140. As the trigger 54 is retracted into its actuated position, it acts through connecting link 140 to raise the stop 138 and move its forwardly-projecting abutment 142 from behind the lower arm 104, thus allowing the clutch actuating means 32 to move rearwardly so as to engage the clutch. With the trigger released, abutment 142 blocks the retraction of the nosepiece 26 which, as previously noted, is necessary to engage the clutch. Thus, if the tool is running and dropped on its nose by the operator, he will, of necessity, let go of the trigger thus interpositioning the abutment 142 and prevented the clutch from engaging which, otherwise, would have actuated the ram to discharge a nail.

In FIGS. 6, 7, 8 and 9, the magazine 64 will be seen to be of more or less conventional design including upper and lower parallelogram-shaped plates 144 and 146 connected along the front edge by a wall 148 that cooperates therewith to produce a rearwardly-opening channel. Tracks 150 spaced to receive the shanks of the nails 62 therebetween and hold same for slidable movement in alignment with the nose 122 of the ram are located just inside the opening in the rear edge. The nail heads butt up against this track and are advanced into position to be driven by a follower 152 which is pulled by a coiled tension spring 154.

The nails themselves are joined together to form a belt by paper tapes 156 in the conventional way as shown. The lead nail of the chain abuts a stop 158 inside the nozzle across from opening 60 that holds it in alignment with the nose of the ram. The second nail, on the other hand, is still held back by the track 150. Therefore, as the ram advances, it strips the lead nail from the belt and drives it on into the workpiece; whereupon, the follower moves the next nail into position to be driven as soon as the clutch actuating means is deactuated, the clutch release means opens the clutch, and the ram retraction spring pulls it back to clear the nozzle. To reload the magazine, the follower is pulled all the way out in much the same way a stapler is loaded. Since no novelty is predicated upon the magazine per se, a detailed description of its structural features would serve no useful purpose. The same is true of the motor speed control circuit of FIG. 12 which has no details identified other than those components which have mechanical significance in the tool itself.

In closing, it should be noted that while the tool shown is specifically designed for driving nail-like fasteners, it is by no means so limited and the ram can impact directly upon an external workpiece in the manner of a stamp, punch or chisel just as well as through the medium of a fastener. It can easily be seen that a tool having the following parameters is practical and, in addition, will perform adequately in any of the previously mentioned applications:

Flywheel Diameter 3"
Flywheel Speed 7000 r.p.m.
Ram Speed 1000 in./sec.
Motor Horsepower 1.125
Total Instrument Wt. 10 lb.

What is claimed is:

1. A fastener driving impact tool comprising in combination:
a housing defining a drive path;
ram means movable along said drive path in a drive stroke;
a pair of counterrotating flywheels supported by said housing; and,
means for transferring energy from said flywheels to said ram means to propel said ram means in a drive stroke.

2. The tool of claim 1, said flywheels being located on opposite sides of said ram means, and said energy transferring means including means for pinching said ram means between said flywheels.

3. The tool of claim 2, further comprising a workpiece engaging means supported on said housing for movement in response to engagement with a workpiece, and link means coupled between said nosepiece and said pinching means for controlling said pinching means in response to movement of said nosepiece.

4. A fastener driving method comprising the steps of:
supplying fasteners in sequence to the path of a fastener driving ram;
counterrotating a pair of flywheels to produce opposed precession forces; and
transferring energy from at least one of said flywheels to said fastener driving ram by a generally lateral relative movement and rotation of said flywheel to drive said fasteners in sequence.

5. The method of claim 4 wherein said transferring step comprises pinching said ram between said flywheels.

6. The method of claim 5 wherein said counterrotating step comprises rotating one flywheel about a relatively fixed axis of rotation and rotating the other flywheel about a relatively movable axis of rotation.

7. The method of claim 6 wherein said pinching step comprises pivoting said relatively movable axis of rotation about a pivot axis substantially spaced from a plane including said axes of rotation.

8. The method of claim 4 including the step of adjusting the speed of rotation of the flywheels to control the energy transferred to the ram.

9. An impact tool for driving fasteners comprising:
a housing defining a drive path;
ram means movable in said drive path;
feed means including a magazine containing a supply of fasteners for supplying fasteners in sequence to said drive path;
flywheel means including a pair of flywheels rotatable in opposite directions to produce opposing precession forces;
power means for rotating said flywheels;
clutch means drivingly coupling at least one of said flywheels and said ram means to propel said ram means in a drive stroke along said drive path toward a fastener disposed in said drive path to impact the fastener; and
control means for controlling the clutch means.

10. The tool of claim 9, further comprising adjustable speed control means coupled to said power means for controlling the speed of rotation of said flywheels.

11. The tool of claim 9, wherein the control means includes means responsive to disposing said housing adjacent a workpiece.

12. The tool of claim 9, wherein the control means includes manually operable means.

13. The tool of claim 9 wherein the power means includes a rotating electric motor and the control means includes a manually operable electric switch for energizing the electric motor.

14. The tool of claim 9, said pair of counterrotating flywheels flanking said ram means.

15. The tool of claim 14, said coupling means including means for moving at least one said flywheel from a first position wherein the gap distance between said flywheels exceeds the thickness of the ram means toward a second position wherein the gap distance is smaller than said thickness.

16. The tool of claim 15, said ram means including a segment of reduced thickness less than said gap distance in said second position.

* * * * *